United States Patent [19]

Larson

[11] Patent Number: 4,884,347

[45] Date of Patent: Dec. 5, 1989

[54] BOW SIGHT

[75] Inventor: Marlow W. Larson, Ogden, Utah

[73] Assignee: Browning, Morgan, Utah

[21] Appl. No.: 270,019

[22] Filed: Nov. 14, 1988

[51] Int. Cl.[4] ..... F41G 1/46

[52] U.S. Cl. ..... 33/265; 124/87

[58] Field of Search ..... 33/265; 124/87

[56] References Cited

U.S. PATENT DOCUMENTS

| | | | |
|---|---|---|---|
| 2,778,701 | 1/1957 | Fleischer | 285/188 |
| 3,013,336 | 12/1961 | Pennington | 33/265 |
| 4,120,096 | 10/1978 | Keller | 33/265 |
| 4,224,741 | 9/1980 | Perry | 33/265 |
| 4,305,208 | 12/1981 | Larson | 33/265 |
| 4,400,887 | 8/1983 | Mason | 33/265 |
| 4,417,403 | 11/1983 | Strange | 33/265 |
| 4,449,303 | 5/1984 | Larson | 33/265 |
| 4,462,163 | 7/1984 | Tentler et al. | 33/265 |
| 4,711,036 | 12/1987 | Morris | 33/265 |
| 4,794,702 | 1/1989 | Martin | 33/265 |
| 4,796,364 | 1/1989 | Amacker | 33/265 |

*Primary Examiner*—William A. Cuchlinski, Jr.
*Assistant Examiner*—Diego F. F. Gutierrez
*Attorney, Agent, or Firm*—Trask, Britt & Rossa

[57] ABSTRACT

An archery sight has a pin plate member which is pivotally mounted for use as a pendulum tree sight but is cageable for use as a field sight. A plurality of individual sight pins, each of which is individually adjustable both vertically and laterally, are carried by the plate.

8 Claims, 2 Drawing Sheets

BOW SIGHT

BACKGROUND OF THE INVENTION

1. Field

This invention relates to sights useful with archery bows. It is more specifically directed to such a sight which is adaptable for use from both elevated and level shooting positions.

2. State of the Art

Bow sights of varying designs have been suggested for use with archery bows. The sights are useful as an aid for determining the proper trajectory of an arrow being shot by an archer. One problem to an archer in the field is to determine the proper trajectory for arrows shot at varying distances. It is important to an archer, once approximating the distance of the shot, to be able reliably to launch his arrow in a trajectory which allows for the normal drop of the arrow over the distance of a shot.

Sights have been developed which provide various beams or sight-point locations for use depending upon the estimated distance of the target. Typical such sights are disclosed by U.S. Pat. No. 2,788,701. U.S. Pat. No. 3,013,336 discloses a sight which determines the degree to which the bow is tipped to secure a desired curved trajectory. With experience, the archer determines the degree necessary for a particular distance and can accurately reproduce that degree of tip for subsequent shots. Conventionally, a bow is regarded as normally held vertically with respect to the earth. "Tipped forward" refers to positioning the upper limb of a bow forward of a vertical reference line, the lower limb being positioned behind that line (toward the archer). The opposite respective positioning of the limbs is regarded as tipping the bow backward.

The problem of an accurate sighting is increased for archers shooting from elevated positions such as from a tree stand. A class of sights commonly known as pendulum sights has evolved to assist archers shooting from elevated positions. An example of such a sight is disclosed in U.S. Pat. No. 4,120,096. According to that patent, a pivoting sighting element carries a number of sight beads spaced along a single row. The sighting element is weighted so that in an unlocked condition, it will assume an approximately horizontal position without regard to the attitude of the archery bow. In locked condition, the sighting element is held approximately vertically, and the individual beads are used for sighting at various distances in conventional fashion. Windage (azimuth) adjustment is possible for the entire sighting element, but not for individual beads.

Individually adjustable pin sights are disclosed in connection with vertical sights by U.S. Pat. No. 4,449,303.

None of the bow sights currently available to archers is completely satisfactory in all circumstances. A number of disadvantages, such as noise of operation, persist when pendulum-type sights are used. Inconveniences and inaccuracies are associated with the calibration of such devices, especially in the field. Because field conditions are often rigorous, the maintenance of typical bow sights in their adjusted condition is problematic. There remains a need for an improved sight which is rugged and reliable under field conditions, provides the benefits of multiple-pin sights for distance shots as well as the benefits of pendulum sight for shots from elevated positions, andn provides for azimuth adjustment of the individual beads used for distance shots.

SUMMARY OF THE INVENTION

The bow sight of this invention combines the benefits of the multiple-pin field sight with those of a pendulum sight. Moreover, it provides in its preferred embodiments a number of improvements enhancing the adjustability and reliability of the various components of the sight.

In its most generalized configuration, the bow sight of this invention includes structure for mounting the bow sight components to the handle riser of an archery bow. This structure generally includes a first portion constituting means for connection to the handle riser and a second portion which includes a pendulum bracket. The two portions of the mounting structure may be integral but are ideally separate and mutually adjustable to accommodate movement of the sight along a vertical axis with respect to the handle riser. The first portion, which is connectable to the handle riser, is adapted for connection to the conventional accessory mounting inserts provided in modern archery bows. When so mounted, the mounting plate projects forward of the handle riser and presents a surface which can couple to the second portion of the mounting structure. The second portion, which includes the pendulum bracket, has a surface which mates with the projecting surface of the mounting plate. The interface between these mating surfaces is ideally provided with serrations or other frictionincreasing elements to insure that once the two portions are fastened together, they will retain their preset positions indefinitely.

The pendulum bracket is fashioned to support and hold in proper relationship the various working elements of the bow sight. Generally, the mating surface of the bracket, that is, the surface which connects to the mounting plate, is fashioned as a vertical structural element or support member from which are cantilevered an upper horizontal member and a lower horizontal member. The vertical support member and the two horizontal members cooperatively define an access window which permits unimpeded operation of the sight and provides access to certain adjustment features of the sight.

A central feature of the bow sight of this invention is a pendulum plate, the major portion of which functions as a sight pin holder. The pendulum plate has an upper portion which includes a pivot journal or comparable means suitable for a pivot connection to other structure. The plate further includes a lower portion which carries structure or is otherwise adapted to cooperate with external structure to releasably lock the pendulum plate into a fixed (locked or "caged") position. The major portion of the plate between the two end portions comprises a vertical sight pin holder. The sight pin holder includes one or more slots adapted to receive a plurality of peep sight pin assemblies. With the pendulum plate mounted at its top by means of a pivot pin, it behaves in the fashion of a pendulum to maintain an essentially vertical position.

A pendulum base or pivot mounting is connected to the upper horizontal member of the pendulum bracket and serves as an attachment point for the pendulum and other auxiliary elements. According to some embodiments, a small light may be mounted above the sight pins. Other embodiments mount a rubber bumper in a position to absorb shock and dampen vibrations when the pendulum is permitted to swing on its pivot pin within the pivot mounting.

The lower horizontal member of the pendulum bracket serves as an attachment point for locking structure. Components connected to this lower horizontal member are cooperatively adapted with components carried at the lower portion of the pendulum pivot plate to effect a locking arrangement. The pendulum plate is normally locked against providing when the sight is used as a normal field sight. As so arranged, the sight has the characteristics of, and may be used in accordance with, the description set forth in the aforementioned U.S. Pat. No. 4,449,303, the disclosure which is incorporated herein by reference.

The pin assemblies useful in connection with the bow sight of this invention are also comparable to those described by the aforementioned U.S. Pat. No. 4,449,303. An important feature of the assemblies as utilized by this invention is their ability to be mounted, in their preferred configurations, firmly and positively within the slots of the vertical sight pin holder. Pin plates are provided within the slots and both the slots and plates are provided with serrations at their edges so that a pin plate, once inserted longitudinal within the slot, will maintain its longitudinal position. The expedient of providing serrations at all adjustment points throughout the interlocking interfaces of the various components of the bow sight of this invention represents an important aspect of the invention. Once assembled in this fashion, there is little likelihood that the sight pins or other components of the assembly will readjust their positions during use.

BRIEF DESCRIPTION OF THE DRAWINGS

In the drawings which illustrate what is presently regarded as the best mode for carrying out the invention.

DESCRIPTION OF THE ILLUSTRATED EMBODIMENTS

Figure 1:
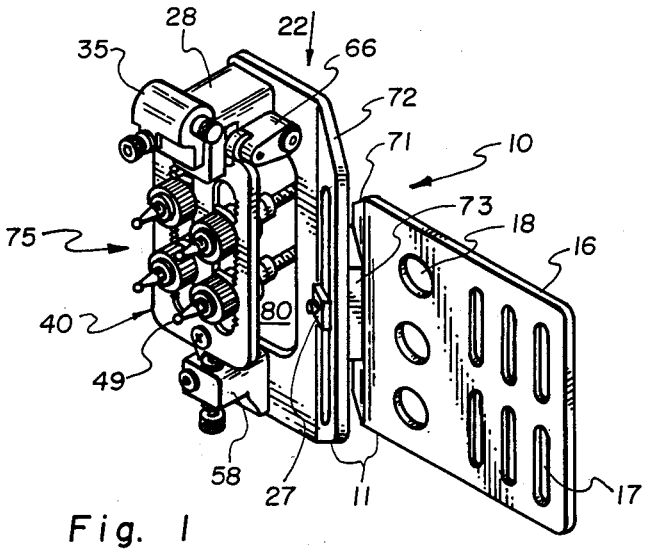
FIG. 1 is a perspective view of the bow sight of this invention fully assembled.
Figure 2:
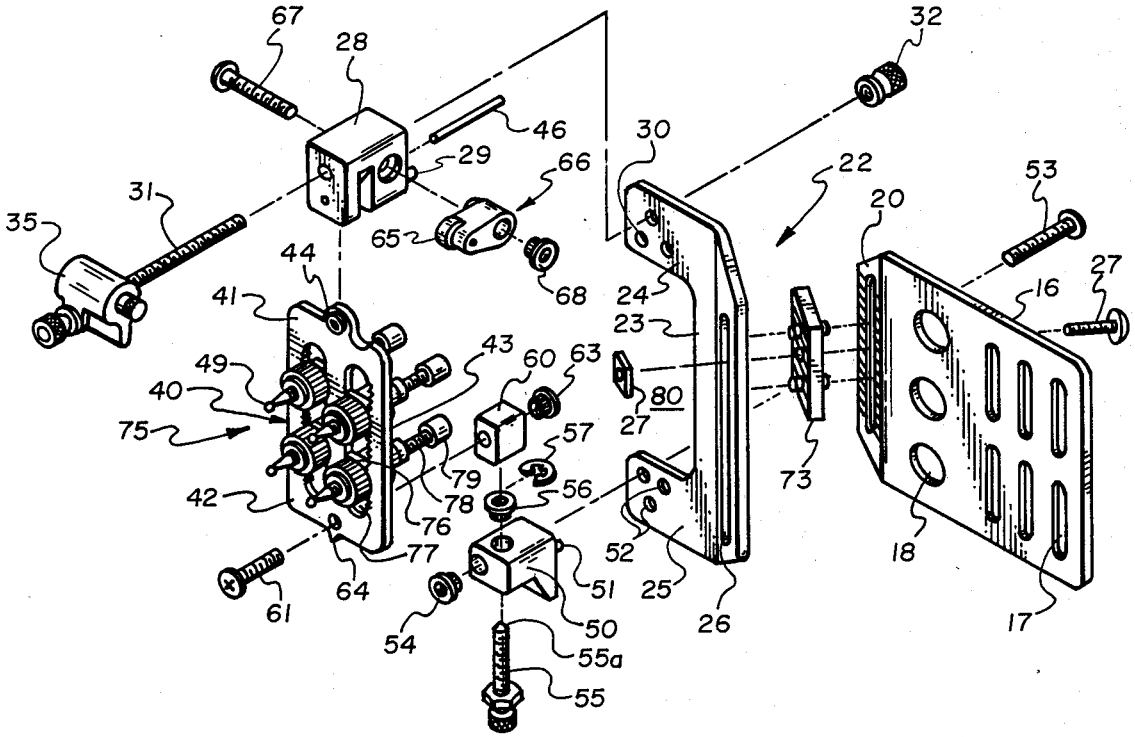
FIG. 2 is an exploded view of the bow sight of FIG. 1 with the exploded components also shown in perspective.
Figure 3:
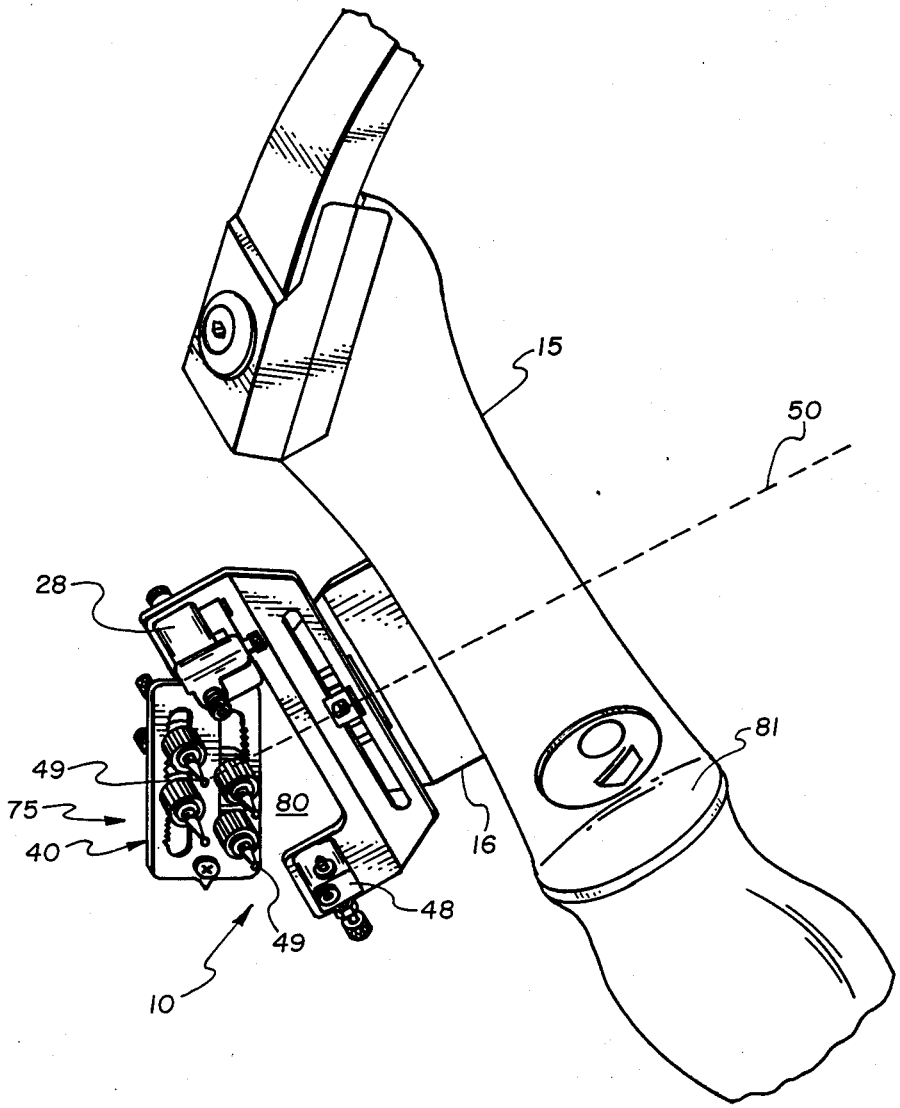
FIG. 3 illustrates the bow sight of FIG. 1 mounted on the handle riser of an archery bow, the riser being shown as a cut-away section of an archery bow and a portion of the bow sight in its pivoted condition.

FIGS. 1 and 2 illustrate a particularly preferred embodiment of the invention, which may be adapted for use with either right-hand or left-hand bows. The bow sight designated generally 10 includes mounting structure designated generally 11 which connects the sight to the handle riser 15 of a bow as shown in FIG. 3. A first portion of the mounting structure 11 comprises a mounting plate 16 adapted by the provision of suitable slots 17 and holes 18 to register with accessory attachment inserts carried by the riser 15. The holes 18 serve to reduce weight of the plate 16. The plate 16 includes a projecting end portion 20, the surface of which is serrated as shown.

The second portion, designated generally 22, of the support structure 11 includes a vertical support member 23, an upper horizontal support member 24, and a lower horizontal support member 25. A pendulum base 28 is fastened to the upper horizontal support member 24 by means of projecting studs 29 registering with holes 30, being held in place with the threaded bolt 31 and nut 32. As illustrated, a miniature light fixture 35 is also held in place by means of the bolt 31.

The vertical support member 23 carries a slot 26 which permits vertical adjustment of the second portion 22 of the support structure with respect to the first portion 16 of the support structure. The two portions are fastened together by means of the threaded bolt and nut 27.

A pendulum plate 40 includes an upper portion 41, a lower portion 42 and an intermediate portion 43, which functions as a sight pin holder. A bushing 44 is carried by the upper portion 41 of the pendulum plate 40. As best shown by FIG. 3, the pendulum plate 40 is suspended from the pivot mount 28 by means of a pivot pin 46 (FIG. 2) journaled through the bushing 44.

FIG. 3 shows the handle riser 15 tipped forward as would be the case from an elevated shooting position with the target at ground level. With the handle riser so tilted, the pendulum plate 40 maintains an approximately vertical position, even through the line of sight 48 departs substantially from horizontal. Sighting is done by reference to the sighting bead 49. Accordingly, the line of sight is automatically raised as the handle riser is tipped as compared to the angle that the line of sight would assume were the pendulum plate 40 not permitted to swing to a vertical orientation as illustrated. FIG. 1 illustrates the pendulum plate in caged or locked condition. A base element 50 is connected to the lower horizontal member 25 of the pendulum bracket 22 by means of studs 51 registering with holes 52, being held in place by the threaded bolt 53 and nut 54. A locking screw 55 is threaded through the insert 56 which is held in place by the slip washer (E ring) 57. A retainer block 60 is similarly fastened to the lower portion 42 of the pendulum plate 40 by means of a screw 61 threaded into a threaded insert 63. An alignment dog 64 depends from the pendulum plate as best seen in FIG. 2.

As the handle riser 15 is tipped back into an approximately vertical position, the pendulum plate swings to maintain its approximately vertical position as the pendulum bracket swings under it into an approximately vertical position or until the plate 40 is contacted by the bumper 65 of a bumper assembly 66 connected to the pendulum base 28 by a bolt 67 and insert 68. The distal end 55A of the screw 55 may then be turned to contact the retainer block 60, thereby holding the pendulum plate into a locked or "caged" condition.

As illustrated, the first 16 and second 22 portions of the mounting structure 11 include extensions 71 and 72, respectively, arranged to prevent mutually opposing high-friction surfaces. Ideally, each of these surfaces is serrated, for example, with a 0.020 pitch. As illustrated, a guide plate 73 is interposed between the extensions 71 and 72. The guide plate is best illustrated by FIG. 2 from which it can be seen that its surfaces are also serrated, for example, by a corresponding 0.020 pitch. The guide plate 73 functions to retain positive vertical alignment between the plate 16 and bracket 22 as their relative positions in their vertical direction are adjusted. The serrations on the various interfaces between the extensions 71 and 72 and plate 73 are maintained by the intercoupling of the serrations on their respective surfaces.

The illustrated sight bead assembly, designated generally 75, includes a fixture 76 adjustably positioned within a slot 77. A pin shaft 78 is held by the fixture 76 approximately transverse the slot 77 and the sight window of riser 15 (FIG. 3). An adjustment knob 79 is carried by a first end of the shaft 78 and is accessible through the access window 80. The second end of the shaft 78 carries the distal sighting bead 49. Each pin shaft 78 is individually adjustable vertically within its respective slot 77 and laterally with respect to the pendulum plate 40 through its respective fixture 76.

An important aspect of this invention is the ability to infinitely adjust the individual sighting beads 49 for windage (azimuth). In the caged condition (FIG. 1), the sight of this invention retains all of the features and benefits of the sight disclosed in the aforementioned U.S. Pat. No. 4,449,303. Moreover, the mechanism 58 used to cage the pendulum plate 40 is positioned in non-interfering relationship with the arrow shaft support 81 and the sight window of the riser 15. It is thus possible, without regard to the attitude of the bow, to draw a broadhead arrow point past the sight in an overdrawn condition.

According to certain highly preferred embodiments, a small quantity of dampening fluid is applied to the surface of the pin 46 prior to insertion through the pivot bearing 44. In practice, the fluid is substantially non migrating over a prolonged period, thereby providing fluid dampening to the pivoting pendulum plate 40 to reduce oscillations of the plate as the attitude of the bow is changed. The pivot bearing 44 is preferably a bushing machined from brass to close tolerance with respect to the pin 46. While various dampening fluids are operable, the presently preferred material for this purpose is a silicon dampening fluid of 3,000,000 centistokes.

Reference herein to the specific details of the illustrated embodiments is not intended to limit the scope of the appended claims, which themselves recite those features regarded as important to the invention.

What is claimed is:

1. An archery bow sight comprising:

mounting structure including a first portion constituting means for connection to the handle riser of an archery bow and a second portion including a pendulum bracket which includes:

a vertical support member, an upper horizontal member, and a lower horizontal member, said members defining an access window;

a pendulum pivot mount carried by said upper horizontal member;

a pendulum plate, with an upper end, pivotally suspended from said pivot mount by a pivot, a lower end, and a central portion constituting a sight pin holder, said holder including at least one sight pin slot approximately parallel said access window;

at least one sight pin assembly operably associated with said slot, said assembly including a fixture adjustably positioned in said slot, a pin shaft held by said fixture approximately transverse said slot and said window, said shaft including a first end accessible through said window and a second end carrying a distal sighting bead; and means carried partially by said lower end of said pendulum plate and partially by said lower horizontal member for releasably locking said pendulum plate to said lower horizontal member.

2. An archery bow sight according to claim 1 further including stop means carried by said second portion of said mounting structure cooperative with said pendulum plate to permit swinging movement of said plate in one direction away from an approximately vertical orientation and to prevent swinging movement of said pendulum plate in the opposite direction beyond said approximately vertical position.

3. An archery bow sight according to claim 2 wherein said stop means comprises a resilient bumper element positioned for contact by said upper portion of said pendulum plate.

4. An archery bow sight according to claim 1 wherein said first portion of said mounting structure includes an extension with a first serrated surface; said second portion of said mounting structure includes an extension with a second serrated surface, said first and second serrated surfaces being approximately parallel each other and further including a guide plate with opposite third and fourth serrated surfaces sandwiched between said first and second serrated surfaces in pressed contact relationship.

5. An archery bow sight according to claim 4 wherein the coupling between said guide plate and said first and second serrated surfaces is releasable to permit adjustment of the relative positions of said first and second portions of said mounting structure.

6. An archery bow sight according to claim 1 wherein said sight pin slot is approximately vertical in orientation and is located with respect to said pivot so a pin shaft carried by said slot rises with respect to the line of sight of an archer using said sight as the sight as tipped forward.

7. An archery bow sight according to claim 6 wherein said sight pin holder includes a plurality of pin slots, and each of said slots carries a plurality of pin assemblies.

8. An archery bow sight according to claim 7 wherein the position of the sight pin shaft of each said assembly is individually adjustable vertically within said slots and laterally with respect to said pendulum plate.

* * * * *